United States Patent [19]

Kishida

[11] 4,267,400

[45] May 12, 1981

[54] SEISMIC BUSHING

[75] Inventor: Mitsuhiro Kishida, Amagasaki, Japan

[73] Assignee: Mitsubishi Denki Kabushiki Kaisha, Tokyo, Japan

[21] Appl. No.: 155,329

[22] Filed: Jun. 2, 1980

[30] Foreign Application Priority Data

Jun. 28, 1979 [JP] Japan ..... 54-82868

[51] Int. Cl.[3] ..... H01B 17/26; H01B 17/30

[52] U.S. Cl. ..... 174/31 R; 174/152 R

[58] Field of Search ..... 174/11 BH, 12 BH, 14 BH, 174/15 BH, 16 BH, 18, 31 R, 42, 75 F, 142, 143, 152 R, 161 R, 167; 52/167

[56] References Cited

U.S. PATENT DOCUMENTS

| | | | |
|---|---|---|---|
| 3,760,089 | 9/1973 | Hildenbrand et al. | 174/12 BH |
| 3,856,242 | 12/1974 | Cook | 52/167 X |

FOREIGN PATENT DOCUMENTS

| | | | |
|---|---|---|---|
| V 9474 | 3/1956 | Fed. Rep. of Germany | 174/161 R |
| 501285 | 2/1939 | United Kingdom | 174/12 BH |

OTHER PUBLICATIONS

Fukazawa, H., et al., "500 Kv Bushings", *Melco Technical Report,* vol. 45, No. 9, 1971, pp. 1094–1104.

*Primary Examiner*—Laramie E. Askin

*Attorney, Agent, or Firm*—E. L. Pencoske

[57] ABSTRACT

A high voltage seismic bushing charged with an insulating material has a porcelain tube having an adapter rigidly connected to one end of the tube. A connecting plate is rigidly connected to a mounting flange. The adapter is flexibly connected to the connecting plate such that the porcelain tube is free to move relative to the mounting flange in the event of an earthquake. The means for flexibly connecting the adapter to the connecting plate utilizes a damping mechanism to attenuate the movement of the porcelain tube. A resilient buffer member is interposed between the adapter and the connecting plate to provide a predetermined spacing therebetween and absorb the impact due to the movement of the adapter relative to the connecting plate. A sealing member seals the interface between the adapter and the connecting plate for containing the insulating material charged therein.

6 Claims, 4 Drawing Figures

SEISMIC BUSHING

BACKGROUND OF THE INVENTION

1. Field of the Invention

This invention relates to a bushing used with the lead wire portion of tank type electrical equipment, such as power transformers or circuit breakers for extra high voltages, 500 kv and above, and wherein the tank is filled with an insulating material such as an insulating gas, an insulating oil or the like.

2. Description of the Prior Art

High voltage electrical equipment may be used in an environment where damage due to airborne pollutants such as salt and dust is high. These devices utilize bushings having long porcelain tubes which increase both the surface leakage distance and the ability to withstand the contaminated environment for connection to overhead aerial wires. When such electrical equipment is employed in a region having a high frequency of occurrence of earthquakes, for example in Japan, they are continually exposed to risks due to the earthquakes and are designed with emphasis on seismic strength. When the bushing is installed and the electrical equipment encounters an earthquake, the amplification of the earthquake experienced by the bushing is affected by the position of installation, the foundation and tank portions of the equipment, the mounting seat for the bushing, etc. The natural frequency of the bushing is determined by the relationship between the weight distribution and the rigidity of the bushing. If the frequency of an earthquake approximates or equals the natural frequency of the electrical equipment, then a resonant phenomenon is developed such that vibrations are amplified to a very large magnitude by each of the tank, bushing mounting seat, etc. These amplified vibrations are applied to the bushing. Such an amplified vibration may exceed the breaking strength of the bushing resulting in the breaking of the porcelain tube.

The greater part of the frequencies of an earthquake ranges generally from one to ten hertz. Bushings mounted on electrical equipment of the 220 kv and higher classifications may have a natural frequency less than ten hertz. This figure is identical to the frequency of earthquakes. With bushings having porcelain tubes having dimensions of up to five meters even the strongest earthquakes experienced in the past do not exceed the breaking strength of these porcelain tubes which have sufficient seismic strength. However, the use of environmentally resistive, long, porcelain tubes of the 500 kv and higher classifications results in a high probability of having the natural frequency of the bushing equal to a few hertz or less which corresponds to the frequency of seismic waves. It is therefore possible to break the environmentally resistive, long, porcelain tubes upon the occurrence of a great earthquake. Strenuous efforts have been made to improve the seismic strength of these bushings. When the 1,000 kv class is put to practical use, one method of increasing the seismic strength of the bushings is by reinforcing the bushing in three or four directions from its extremity by means of stay porcelain tubes or the like. In this case, the vibration of the stays becomes a chordal vibration and a phenomenon is developed which includes a superimposed vibration different from that of the bushing portion. Thus, it is difficult to analyze the seismic strength and the reliability of the bushing. Also, it is necessary to consider the flashover voltage due to contamination when the stay porcelain tube portions are connected in parallel. The adhesion of contaminants is different between the bushing and stay porcelain tubes. With the stay porcelain tubes being smaller in diameter they are generally apt to be contaminated. In any case it is necessary to determine the magnitude of the flashover voltage in the parallel state. In this respect the reliability is also reduced. The present invention eliminates the need for stay porcelain tubes.

SUMMARY OF THE INVENTION

A bushing has a flexible connection between a porcelain tube and a mounting flange such that a clearance may develop between the porcelain tube and the mounting flange upon the application of a high load. The flexible connection includes a damper mechanism for absorbing vibrational energy simultaneously with the occurrence of the clearance whereby, upon the bushing encountering an earthquake causing large vibrations, the same is prevented from breaking by absorption of the vibrational energy.

DESCRIPTION OF THE PREFERRED EMBODIMENT

Figure 1:
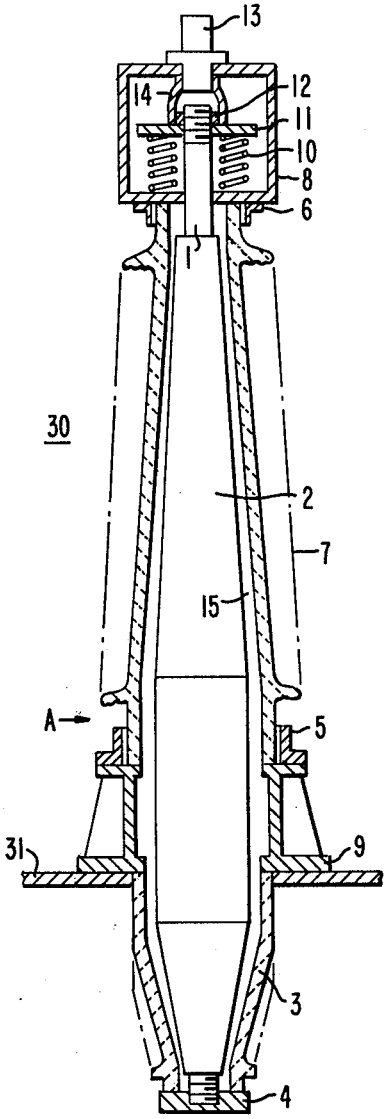
FIG. 1 PRIOR ART
FIG. 1 is a sectional view of a conventional bushing.

When an environmentally resistive type bushing 30, shown in FIG. 1, of the 500 kv or higher classifications, is designed according to the conventional concept there is provided a condenser capacitor portion 2 comprised of insulating paper wound into a cylinder around a central conductor 1. An electric field adjusting electrode is inserted in concentric cylindrical relationship into the capacitor portion 2 so as to render an internal and an external electric field uniform. Supported at the lowermost end of the bushing 30 is a lower porcelain tube 3. The central conductor 1 is threaded at its lower end and has fixed thereto a metallic support fitting 4 also acting as a metallic terminal fitting. A gasket (not shown) and a mounting flange 9 are located at the upper end of the lower porcelain tube 3 for disposing and fixing the bushing 30 in sealed relationship through an opening disposed in the main body or casing 31 of an electrical apparatus. An upper porcelain tube 7 has attached thereto metallic tube fittings 5 and 6 fixed to the lower and upper portions thereof, respectively, by a cement. The lower fitting 5 is placed along with a gasket (not shown) on, and fixed to, the flange 9 by bolts and nuts (not shown). Upon the upper portion a metallic head fitting 8 is put and similarly fixed. The interior of the head fitting 8 accommodates a coiled spring 10 for imparting a compressive force to the porcelain tubes 3 and 7 and the mounting flange 9. A spring clamp plate 11 for compressing the coiled spring 10 and a ring-shaped nut 12 fix the compressive force of the spring 10. Further, in a structure in which there is a flexible lead 14 connecting a metallic terminal fitting 13 to the central conductor 1, there is included an insulating oil 15 filling the interior. A gas space is provided in the metallic head fitting 8 which has a suitable volume so as to prevent an extraordinary change in pressure upon a change in the volume of the insulating oil 15. This space is charged with an inert gas such as nitrogen or the like under a suitable pressure. When the bushing is installed on an electrical apparatus which has encountered an earthquake, the vibrations are amplified between the ground and the porcelain tubes of the bushing. However, by making the rigidity of every portion high the extent of amplification becomes small resulting in an increase in the seismic strength. Accordingly, the rigidity of the mounting flange 9 is also designed to be as high as possible.

When a bushing of this type is provided on an electrical apparatus, the apparatus as a whole has been designed with particular emphasis on seismic strength. The amplification experienced by the mounting flange may be greater than twice the seismic acceleration. Further, the extremity of the bushing may experience ten odd times the seismic acceleration. It is necessary for the bushing to endure these amplified vibrations. While mechanical stress is different for each portion of the bushing, a maximum bending stress is experienced on the upper surface portion of the lower fitting 5 of the upper porcelain tube 7, as illustrated by the arrow A in FIG. 1. The porcelain tube 7 has a bending stress on the order of from 200 to 250 kilograms per square centimeter and may be broken in excess of this stress.

In bushings having a porcelain tube whose dimensions are not so large as the dimensions of the environmentally resistive bushings of the 500 kv or higher classifications, the natural frequency is high and the resonant phenomenon is less predominate. Also, the diameter of the porcelain tube is relatively large with respect to the weight of the bushing resulting in a sufficient seismic strength. However, for environmentally resistive bushings of the 500 kv or higher classifications the surface leakage distance must necessarily be long and therefore long porcelain tubes are employed. The diameter of these long porcelain tubes is not so large in spite of their heavy weight. Thus, the natural frequency is low and apt to equal the frequency of earthquakes resulting in large vibrations due to the resonant phenomenon. It is expected that the internal stress of the long porcelain tubes at the time of the earthquake exceeds their breaking stress. Accordingly, environmentally resistive bushings of the 500 kv or higher classifications require, according to the conventional concept, the counter measure of reinforcing the long porcelain tubes by providing stay porcelain tubes in three or more directions therearound from the extremity of the bushing. The use of the stay porcelain tubes has raised difficult questions about their reliability as described above.

Figure 2:
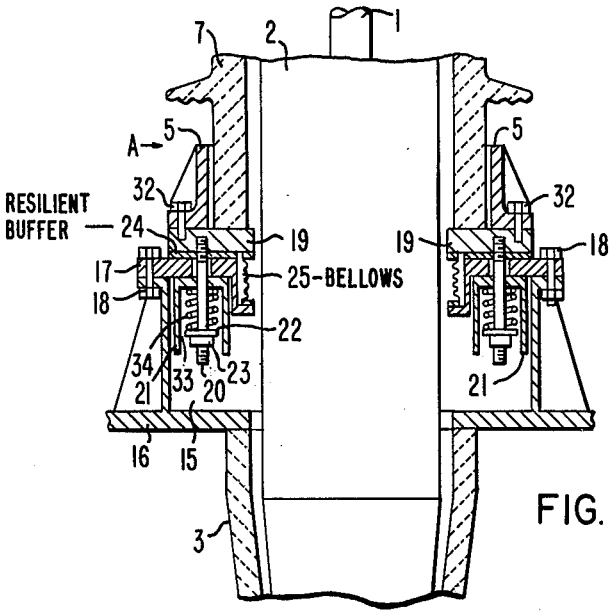
FIG. 2 is a sectional view illustrating the preferred embodiment of a seismic bushing constructed according to the teachings of the present invention.
Figure 3:
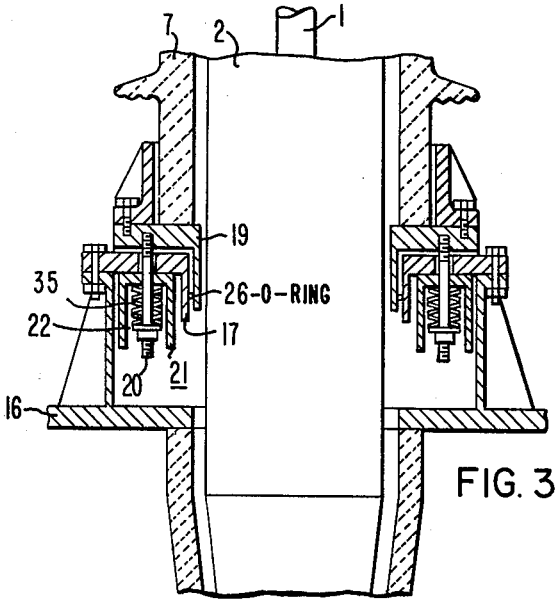
FIGS. 3 and 4 are sectional views of other embodiments of the present invention.

Turning now to the present invention the description is made hereinafter with respect to FIGS. 2, 3 and 4. In the Figures the identical reference numerals are used to identify identical or corresponding components. In FIG. 2 the central conductor 1, the capacitor portion 2, the lower porcelain tube 3, the lower tube fitting 5, and the upper porcelain tube 7 are similar to the conventional components. The lower porcelain tube 3 is rigidly secured to a mounting flange 16. A connecting plate 17 is rigidly connected to the upper surface of the mounting flange 16 by bolts and nuts 18. The connecting plate 17 has a plurality of cylindrical pots 21 extending downward into the flange 16. Pots 21 are tubular members having one partially closed end and one open end defining a cylindrical recess or chamber accessible from the open end. An adapter 19 is rigidly connected to the lower fitting 5 of the upper porcelain tube 7 by bolts 32. When the upper porcelain tube 7, the lower fitting 5 and the adapter 19 vibrate together, a plurality of connecting rods 20 transmit any dimensional change that develops between the adapter 19 and the connecting plate 17. Each of the connecting rods 20 is positioned within the recess of one of the cylindrical pots 21 and has one end disposed through an opening in the partially closed end of pot 21. This end of the rod is connected to the adapter 19. The other end of the connecting rod 20 has a coil spring 34 telescoped thereon which is secured by a spring seat, a piston head 22, and a nut 23. The piston head 22 has a diameter such that a predetermined gap 33 is established between the piston head 22 and the inner wall of the cylindrical pot 21. The combined effect of the connecting rods 20, piston heads 22 and the cylindrical pots 21, which are filled with the oil 15, is to provide a plurality of dashpots for absorbing and dissipating the energy of motion of the upper porcelain tube 7. The plurality of coiled springs 34 impart a fastening force between the connecting plate 17 and the adapter 19 through the connecting rods 20. In addition to connecting the piston heads 22 to the connecting rods 20, the nuts 23 determine the spring tension of the coiled springs 34. The coiled springs 34 also absorb and dissipate the energy of motion of the upper porcelain tube 7. A resilient buffer member 24 is interposed between the connecting plate 17 and the adapter 19 to alleviate collisions therebetween upon the development and the closing of a clearance between the connecting plate 17 and the adapter 19 due to vibrations. A sealing member 25 consisting of a bellows prevents the insulating fluid 15, which fills the interior of the bushing 30, from leaking even though an opening develops between the connecting plate 17 and the adapter 19 during the vibration.

In a bushing constructed according to the teachings of the present invention the fastening force is set to a magnitude such that a sufficient margin exists between the internal stress at the portion of the bushing represented by the arrow A and the breaking stress. When properly set, during a large vibration the instant the amplitude of the bending load exceeds the fastening force exerted by the springs 34 an opening or clearance is developed between the connecting plate 17 and the adapter 19. The position of the piston heads 22 changes due to movement of the connecting rods 20. As a result, vibrational energy is absorbed by the springs 34 and the damping effect caused by both the movement of the piston head 22 and the insulating fluid 15 filling the interior of the mounting flange 16.

The above-mentioned embodiment has been described in conjunction with a structure wherein the damping effect is due to the coiled springs combined with that caused by the dashpots. However, if ring-shaped or dished springs 35, as shown in FIG. 3, are used, then the damping effect resulting from the internal friction of the springs themselves can be expected to provide additional vibrational attenuation.

Furthermore, the above-mentioned embodiment has been described in conjunction with a structure in which the sealing member 25 maintains a seal even though a clearance may develop between the connecting plate 17 and the adapter 19. However, by changing to an O-ring 26, as shown in FIG. 3, the seal can also be maintained.

Figure 4:
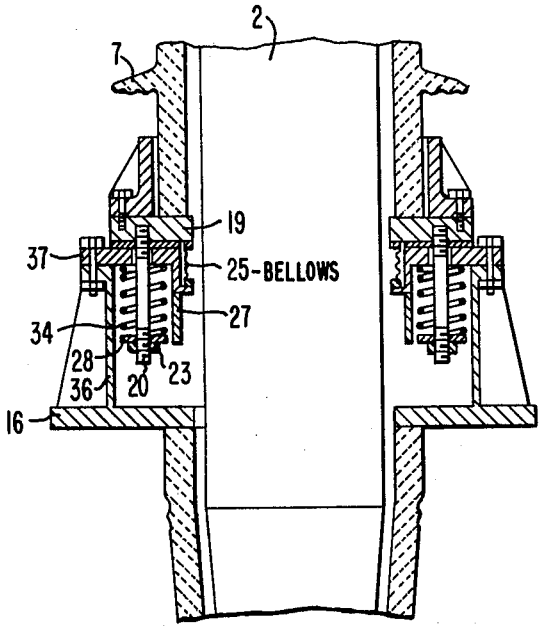

Turning to FIG. 4 an alternative embodiment is shown. A connecting plate 37 has a cylindrical member 27 concentric with the mounting flange 16 and parallel to the vertical wall 36 of the mounting flange. A plurality of connecting rods 20 and springs 34 are disposed at equal intervals at the circumference of a circle defined as being equidistant from the cylindrical member 27 and the vertical wall 36 of the mounting flange 16. A ring or donut-shaped piston head 28 is fixed to the connecting rods 20 by the plurality of nuts 23. Suitable gaps are provided between the piston head 28 and the walls of the double cylindrical portion such that the entire flange 16 and connecting plate 37 act as a large fluid filled dashpot providing the necessary attenuation of large vibrations.

Where a bushing constructed according to the teachings of the present invention is mounted to a tank-shaped electrical apparatus, such as a transformer or the like, the occurrence of an earthquake causes the bushing to be subjected to a large vibration that has been amplified by the foundation, the main body, the bushing mounting flange, etc. However, the vibrational system changes at, and after, the instant that an opening develops between the connecting plate 17 and the adapter 19 so that the natural frequency of the bushing is lowered. When the vibrational amplitude tends to be still larger, energy is absorbed by the damper mechanism and the attenuation increases causing a decrease in the response to the seismic acceleration. Thus, stresses generated in the porcelain tube can be controlled so as not to exceed the breaking stress even during a large earthquake.

Briefly reviewing, according to the present invention a plurality of springs provide a fastening force between an adapter and a mounting flange. Upon the occurrence of a great earthquake fluid-filled dashpot structures together with the springs absorb vibrational energy simultaneously with the development of a clearance between the adapter and the mounting flange. In this manner the internal stress of the porcelain tube can be controlled so as not to be greater than the breaking stress.

I claim:

1. A seismic bushing for a high voltage electrical apparatus charged with an insulating material and having a cylindrical mounting flange, comprising:

a porcelain tube;

an adapter rigidly connected to one end of said tube;

a connecting plate having a plurality of cylindrical pots, said plate being rigidly connected to the mounting flange such that said pots extend into said mounting flange;

a plurality of piston heads located within said cylindrical pots;

a plurality of connecting rods located within said cylindrical pots, said connecting rods being connected at one end to said adapter and at the other end to said piston heads;

a plurality of springs disposed on said connecting rods, said springs providing a predetermined fastening force between said adapter and said connecting plate such that said tube is free to move relative to said mounting flange, said springs and said piston heads absorbing the energy of said motion upon the development of a clearance between said adapter and said connecting plate;

a resilient buffer member interposed between said adapter and said connecting plate to provide mechanical stress relief upon the closing of said clearance between said adapter and said connecting plate; and a sealing member for sealing the interface between said adapter and said connecting plate for containing the insulating material.

2. The bushing of claim 1 wherein the springs include coiled springs such that internal friction of said coiled springs absorbs the energy of motion of the tube.

3. The bushing of claim 1 wherein the springs include a combination of dished springs such that internal friction of said dished springs absorbs the energy of motion of the tube.

4. A seismic bushing for a high voltage electrical apparatus charged with an insulating material and having a cylindrical mounting flange, comprising:

a porcelain tube;

an adapter rigidly connected to one end of said tube;

a connecting plate having a cylindrical member, said connecting plate being rigidly connected to the mounting flange such that said cylindrical member is concentric with said mounting flange;

a ring-shaped plate member located between said mounting flange and said cylindrical member;

a plurality of connecting rods located between said mounting flange and said cylindrical member, said connecting rods connected at one end to said adapter and connected at the other end to said plate member;

a plurality of springs disposed on said connecting rods, said springs providing a predetermined fastening force between said adapter and said connecting plate such that said tube is free to move relative to said mounting flange, said springs and said plate member absorbing the energy of said motion upon the development of a clearance between said adapter and said connecting plate;

a resilient buffer member interposed between said adapter and said connecting plate to provide mechanical stress relief upon the closing of said clearance between said adapter and said connecting plate; and a sealing member for sealing the interface between said adapter and said connecting plate for containing the insulating material.

5. The bushing of claim 4 wherein the springs include coiled springs such that internal friction of said coiled springs absorbs the energy of motion of the tube.

6. The bushing of claim 4 wherein the springs include a combination of dished springs such that internal friction of said dished springs absorbs the energy of motion of the tube.

* * * * *